US006690106B1

(12) United States Patent
Yoshida et al.

(10) Patent No.: US 6,690,106 B1
(45) Date of Patent: Feb. 10, 2004

(54) COLOR CATHODE RAY TUBE

(75) Inventors: Haruhiko Yoshida, Oohara (JP); Nobuhiko Hosotani, Mobara (JP); Mitsuru Watanabe, Mutsuzawa (JP); Hiroshi Itou, Chiba (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/959,412

(22) PCT Filed: Apr. 28, 1999

(86) PCT No.: PCT/JP99/02280

§ 371 (c)(1),
(2), (4) Date: Oct. 26, 2001

(87) PCT Pub. No.: WO00/67284

PCT Pub. Date: Nov. 9, 2000

(51) Int. Cl.[7] ..... H01J 29/10; H01J 29/86
(52) U.S. Cl. ..... 313/461; 313/477 R
(58) Field of Search ..... 313/477 R, 461, 313/493, 462, 469; 220/2.1 A, 2.3 A

(56) References Cited

U.S. PATENT DOCUMENTS 4,590,404 A * 5/1986 D'Amato ..... 313/477 R
4,755,868 A * 7/1988 Hodges ..... 348/780
4,881,004 A * 11/1989 Inoue et al. ..... 313/408
4,904,899 A * 2/1990 Nakata et al. ..... 313/477 R
5,552,663 A * 9/1996 Iida et al. ..... 313/461
5,645,461 A * 7/1997 Iwasaki ..... 445/11
5,962,964 A * 10/1999 Sano et al. ..... 313/440
6,133,681 A * 10/2000 Nakamura et al. ..... 313/402

FOREIGN PATENT DOCUMENTS

JP 59-165351 * 9/1984 ..... H01J/29/86

* cited by examiner

*Primary Examiner*—Nimeshkumar D. Patel
*Assistant Examiner*—Glenn D. Zimmerman
(74) *Attorney, Agent, or Firm*—Antonelli, Terry, Stout & Kraus, LLP

(57) ABSTRACT

A color cathode ray tube is constituted of a glass bulb which includes a panel portion having a faceplate portion with a phosphor screen on an inner surface thereof, a neck portion in which an electron gun is mounted, and a funnel portion which connects the panel portion and the neck portion. Assuming a thickness of a screen effective area of the faceplate portion along the tube axis direction as tc at a central section thereof, as tx at a peripheral section thereof along the major axis direction, and as td at a peripheral section thereof along the diagonal direction, the cathode ray tube has the relationship tc>td>tx.

4 Claims, 6 Drawing Sheets

Rpo>Rpi+tpc
tpa>tpc

COLOR CATHODE RAY TUBE

The present invention relates to a color cathode ray tube of the type which is used in a color television set for personal use and to a color display monitor for an information terminal; and, more particularly, the invention relates to a color cathode ray tube which has a faceplate panel of improved curved shape.

BACKGROUND OF THE INVENTION

The glass envelope of a cathode ray tube generally comprises a panel portion having a curved faceplate, a neck portion with a reduced diameter, and an approximately funnel-shaped portion which connects the panel portion and the neck portion. The cathode ray tube further includes a phosphor screen formed over the inner surface of the faceplate, an electron gun installed inside of the neck portion, and a deflection yoke mounted on an outer periphery of the funnel portion. Here, the glass envelope of the cathode ray tube has a near vacuum in its interior, with atmospheric pressure being impressed on it, outer side at all times, so that the glass envelope is required to have a mechanical strength that is higher than a predetermined level. For this reason, various parts of the glass envelope are formed to a sufficient thicknesses to be able to provide the corresponding required mechanical strengths.

In a known cathode ray tube, the faceplate of the glass envelope normally has a construction in which the peripheral section of the faceplate is made thicker than the central section of the faceplate. FIG. 11 is a cross-sectional view showing one example of the constitution of the faceplate portion of a glass envelope of the type used in a known cathode ray tube.

In FIG. 11, numeral 31 indicates a faceplate, numeral 31(1) indicates an inner surface of the faceplate, numeral 31(2) indicates an outer surface of the faceplate, tpc indicates the thickness of a central section of the faceplate 31, tpa indicates the thickness of a peripheral section of the faceplate 31, Rpi indicates the radius of curvature of the inner surface 31(1) of the faceplate with a deflection center point O of the electron beam taken as its center, and Rpo indicates the radius of curvature of the outer surface 31(2) of the faceplate with the deflection center point O of the electron beam taken as its center.

As shown in FIG. 11, the faceplate 31 is constructed such that the thickness tpa of the peripheral section is greater than the thickness tpc of the central section so as to provide the required mechanical strength as described above. As a result, the radius of curvature Rpi of the inner surface 31(1) of the faceplate is smaller than the radius of curvature Rpo of the outer surface 31(2) of the faceplate, that is, tpc<tpa and Rpi<Rpo.

In the above-described known cathode ray tube, the thickness tpc of the central section of the faceplate 31 is thin and the thickness tpa of the peripheral section is thick so that when an image is displayed on the phosphor screen formed on the inner surface of the faceplate 31, light irradiated outwardly from the phosphor screen through the faceplate 31 becomes attenuated more at the peripheral section of the faceplate 31 having the large thickness tpa than at the central section of the faceplate 31 having the small thickness tpc. That is, if we let Tpc stand for the light transmittivity at the central section of the faceplate 31 and Tpa for a light transmittivity at the peripheral section, then Tpc>Tpa and the brightness of the displayed image is lower at the peripheral section of the faceplate 31 than at the central section of the faceplate 31, thus giving rise to a problem that the brightness of a displayed image cannot be ensured at a sufficient level at the peripheral section. The brightness at the peripheral section is further degraded by the fact that the weight of the phosphor is smaller at the peripheral section of the screen than at the central section of the screen.

To correct the brightness of the displayed image at the peripheral section of the faceplate 31 so that it will match the brightness of the displayed image at the central section, when the brightness of the displayed image at the peripheral section of the faceplate 31 is lowered compared with the brightness of the displayed image at the central section, the intensity of the electron beam projected onto the peripheral section of the phosphor screen needs to be stronger than the intensity of the electron beam projected onto the central section of the phosphor screen. Such a means for correcting the electron beam intensity, however, cannot be easily obtained.

To cope with such a problem, an applicant of the present invention filed an application (Japanese Laid-open Patent Publication 18547/1998), in which the curved shape of the faceplate of a cathode ray tube is formed such that the radius of curvature of the inner surface thereof is larger than the radius of curvature of the outer surface, and the thickness of the peripheral section is made thin compared with the thickness of the central section of the faceplate, so that the brightness of a displayed image at the peripheral section of the faceplate is increased, and the brightness of the displayed image at the peripheral section is approximated to the brightness of the displayed image at the central section.

However, in the above-mentioned cathode ray tube, since the radius of curvature of the inner surface of the faceplate is larger than that of the outer surface of the faceplate, the radius of curvature of a shadow mask, which is arranged to face the phosphor screen formed on the inner surface of the faceplate in an opposed manner and performs color selection, becomes large as a whole. In a cathode ray tube having such a constitution, since the molding retaining strength of the curved surface of the shadow mask becomes weak, the curved surface is easily deformed, so that the electron beams which pass through apertures formed in the shadow mask do not normally impinge on the phosphor screen (making it impossible to perform normal color selection) whereby there arises a new problem in that a deterioration of the color purity of the displayed image is induced.

Particularly, at the peripheral section of the screen along the minor axis direction, the shadow mask is liable to be easily influenced by vibrations or an impact at the time of dropping; and, hence, when the radius of curvature of the shadow mask is increased, the mechanical strength of the curved surface becomes weak, so that the curved surface is liable to be easily deformed in that area.

Further, the inside of the glass bulb is approximately in a vacuum state and atmospheric pressure is always applied to the outside of the glass bulb. Accordingly, in view of the geometric structure of the glass bulb for a cathode ray tube, a stress strain is liable to be concentrated on the peripheral section of the screen, along the minor axis direction in particularly; and, hence, when the glass thickness of the peripheral section along the minor axis direction becomes thin by increasing the radius of curvature of the inner surface of the faceplate, the mechanical strength of the glass bulb (panel portion) becomes weak in that area.

Further, at the peripheral section of the screen along the diagonal direction, the distance from the center of the screen becomes longest; and, hence, when the radius of curvature of the shadow mask becomes large, the molding retaining strength of the curved surface is decreased, so that the curved surfaces are liable to be easily deformed between the center and the peripheral section along the diagonal direction.

The present invention has been made to solve the foregoing problems, and it is an object of the present invention to provide a color cathode ray tube in which the brightness of a displayed image at a peripheral section of a faceplate will match the brightness of a displayed image at a central section of the faceplate using means having a simple constitution and, at the same time, can prevent the degradation of the color purity of the displayed image and the lowering of the mechanical strength of the glass bulb.

SUMMARY OF THE INVENTION

To achieve the above-mentioned object, in the cathode ray tube according to the present invention, the thickness of the glass and/or the radius of curvature of a faceplate panel are constituted as follows.

(1) Assuming a thickness of a screen effective area of a faceplate portion along the tube axis direction as tc at a central section thereof, as tx at a peripheral section along the major axis direction and as td at a peripheral section along the diagonal direction, the relationship tc>td>tx is established. Due to such a constitution, the brightness of a displayed image at the peripheral section is enhanced and, at the same time, the radius of curvature of the shadow mask between tire central section and the peripheral section along the diagonal direction can be made small, so that it becomes possible to prevent the lowering of the molding retaining strength of the curved surface.

(2) Assuming a thickness of a screen effective area of a faceplate portion along the tube axis direction as tc at a central section thereof and as tx at a peripheral section along the major axis direction, the relationship tc>tx is established, and assuming an equivalent radius of curvature of a screen effective area of an inner surface of the faceplate portion as Rix in the major axis direction and as Rid in the diagonal direction, the relationship Rix>Rid is established. Due to such a constitution, the brightness of a displayed image at the peripheral section is enhanced and, at the same time, the lowering of the molding retaining strength of the curved surface of the shadow mask between the central section and the peripheral section along the diagonal direction can be prevented.

(3) Assuming a thickness of a screen effective area of a faceplate portion along the tube axis direction as tc at a central section thereof, as tx at a peripheral section along the major axis direction and as ty at a peripheral section along the minor axis direction, the relationship tc>ty>tx is established. Due to such a constitution, the brightness of a displayed image at the peripheral section is enhanced and, at the same time, the lowering of the mechanical strength of an evacuated glass bulb (panel portion) at the peripheral section along the minor axis direction can be prevented. Further, the radius of curvature of the shadow mask at the peripheral section along the minor axis direction becomes small so that the lowering of the mechanical strength of the shadow mask can be prevented.

(4) Assuming a thickness of a screen effective area of a faceplate portion along the tube axis direction as tc at a central section thereof and as tx at a peripheral section along the major axis direction, the relationship tc>tx is established, and assuming an equivalent radius of curvature of the screen effective area of an inner surface of the faceplate portion as Rix in the major axis direction and as Riy in the minor axis direction, the relationship Rix>Riy is established. Due to such a constitution, the brightness of a displayed image at the peripheral section is enhanced and, at the same time, the lowering of the mechanical strength of an evacuated glass bulb (panel portion) and the shadow mask at the respective peripheral sections along the minor axis direction can be prevented.

(5) Assuming a thickness of a screen effective area of a faceplate portion along the tube axis direction as tc at a central section thereof, as ty at a peripheral section along the minor axis direction and as td at the peripheral section along the diagonal direction, the relationship tc>td>ty is established, and assuming an equivalent radius of curvature of the screen effective area of an inner surface of the faceplate portion as Riy in the minor axis direction and as Rid in the diagonal direction, the relationship Rid>Riy is established, and assuming an equivalent radius of curvature of a screen effective area of an outer surface of the faceplate portion as Roy in the minor axis direction and as Rod in the diagonal direction, the relationship Rod>Roy is established. Also, due to such a constitution, the brightness of a displayed image at the peripheral section is enhanced and, at the same time, the lowering of the mechanical strength of an evacuated glass bulb (panel portion) and the shadow mask at the respective peripheral sections along the minor axis direction can be prevented.

Further, in addition to the above-mentioned constitutions, when necessary, the hole transmittivity of a black matrix for forming phosphor dots or stripes on a phosphor screen is defined in a given range.

According to the above-mentioned constitutions of the present invention, the brightness of the displayed image at the peripheral section of the faceplate can be made to match the brightness of the displayed image at the central section so that when electron beams are irradiated to the phosphor screen on the inner surface of the faceplate, the brightness of the image displayed on the phosphor screen is prevented from being lowered at the peripheral section, whereby the uniformity of the brightness of the whole surface of the display screen can be maintained. Further, since it is no longer necessary to excessively increase the hole transmittivity of the black matrix at the periphery of the screen, a color cathode ray tube which does not give rise to a large deterioration of the resolution at the periphery of the screen and which exhibits a favorable color purity can be obtained.

BEST MODE FOR CARRYING OUT THE INVENTION

Various embodiments of the present invention will be explained hereinafter in conjunction with the accompanying drawings.

Figure 1:
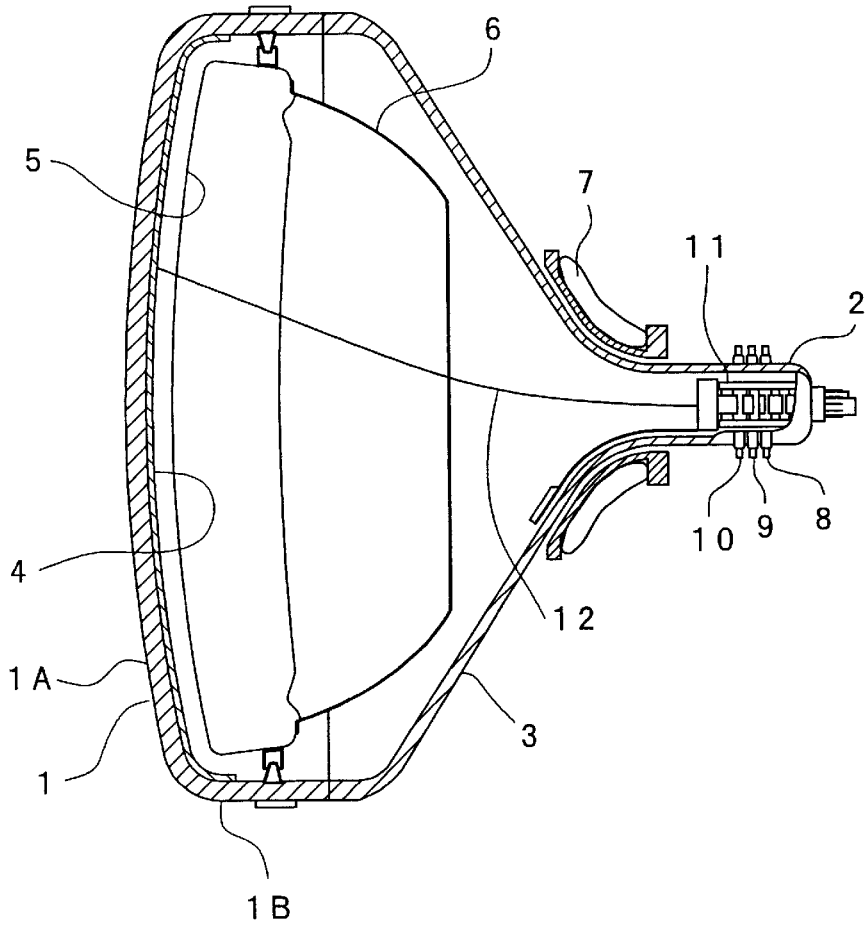
FIG. 1 is an axial cross-sectional view showing the constitution of one embodiment of a cathode ray tube according to the present invention.

FIG. 1 is a cross-sectional view showing the constitution of one embodiment of a cathode ray tube according to the present invention, and it illustrates an example in which the cathode ray tube is constituted as a color cathode ray tube.

In FIG. 1, the cathode ray tube has a panel portion 1, a faceplate 1A, a panel skirt portion 1B, a neck portion 2, a funnel portion 3, a phosphor film 4, a shadow mask 5, an inner magnetic shield 6, a deflection yoke 7, a purity adjusting magnet 8, a center beam static convergence adjusting magnet 9, a side beam static convergence adjusting magnet 10, an electron gun 11, which generates electron beam 12.

A glass envelope (bulb) which constitutes the color cathode ray tube is comprised of the panel portion 1, which is arranged at the front side and has a large diameter, a thin elongated neck portion 2, which accommodates the electron gun 11, and the funnel portion 3, which is formed in an approximately funnel shape and connects the panel portion 1 and the neck portion 2. The panel portion 1 includes the faceplate 1A, which constitutes a front surface, and a skirt portion 1B, which is connected to the funnel portion. The phosphor film 4 is formed on an inner surface of the faceplate 1A by coating, and the shadow mask 5 is mounted such that the shadow mask 5 is arranged to face the phosphor film 4 in an opposed manner. The inner magnetic shield 6 is mounted inside of a connecting portion of the panel portion 1 and the funnel portion 3, while the deflection yoke 7 is arranged at the outside of the connecting portion of the funnel portion 3 and the neck portion 2. Three electron beams (only one beam shown in the drawing) which are irradiated from the electron gun 11 are deflected in given directions by the deflection yoke 7 and impinge on the phosphor film 4 through the shadow mask 5. Here, the purity adjusting magnet 8, the center beam static convergence adjusting magnet 9 and the side beam static convergence adjusting magnet 10 are arranged in parallel outside the neck portion 2.

The operation of the color cathode ray tube having such a constitution, that is, the image displaying operation, is the same as the image display operation of a known color cathode ray tube, and, hence, such an explanation is omitted.

Figure 2:
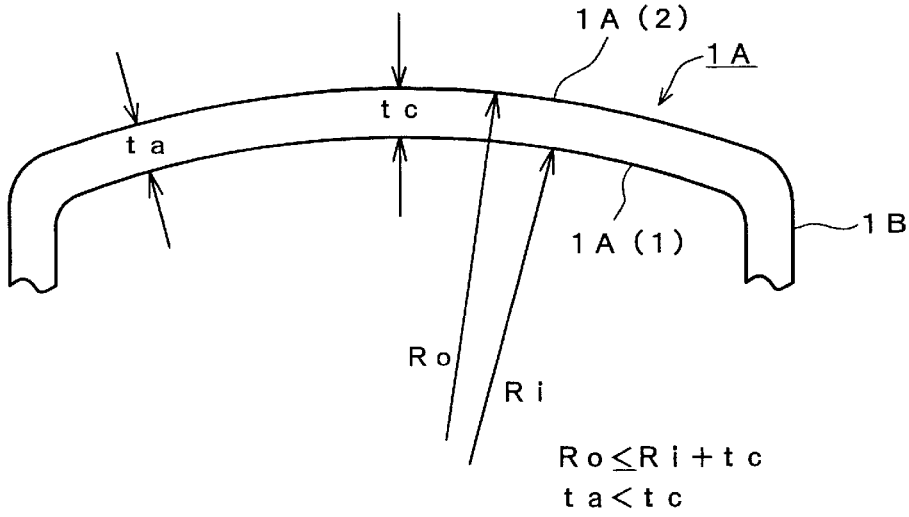
FIG. 2 is a cross-sectional view of an embodiment of a panel faceplate according to the present invention.

FIG. 2 is a cross-sectional view showing the constitution of the faceplate 1A portion of the panel portion 1 in the color cathode ray tube of the embodiment shown in FIG. 1.

In FIG. 2, numeral 1A(1) indicates the faceplate inner surface, numeral 1A(2) indicates the faceplate outer surface, tc indicates the thickness of the central section of the faceplate 1A, ta indicates the thickness of the peripheral section of the faceplate 1A, Ri indicates the radius of curvature of the faceplate inner surface 1A(1), and Ro indicates the radius of curvature of the faceplate outer surface 1A(2). Further, with respect to components which are identical with the components shown in FIG. 1, the same symbols are employed. Here, the thicknesses tc, ta of the central and peripheral sections of the faceplate 1A indicate the shortest distances between the faceplate inner surface 1A(1) and the faceplate outer surface 1A(2) at respective sections. Further, since the radii of curvature of the inner and outer surfaces of the faceplate are usually considerably larger than the thickness of the faceplate, tire thickness ta at the peripheral section of the faceplate 1A may be replaced by the distance between the faceplate inner surface 1A(1) and the faceplate outer surface 1A(2) which is parallel to the tube axis direction.

As shown in FIG. 2, with respect to the faceplate 1A of this embodiment, the relationship between the radius of curvature Ri of the faceplate inner surface 1(1) and the radius of curvature Ro of the faceplate outer surface 1A(2) is set to $Ro \leqq Ri+tc$, and the thickness ta of the peripheral section of the faceplate can be set to a value approximately equal to or slightly thinner than the thickness tc of the central section.

The faceplate 1A of the panel portion 1 of this embodiment is designed through following steps.

First of all, at step Si, the radius of curvature Ro of the faceplate outer surface 1A(2) of the faceplate 1A is set.

Then, at step S2, the thickness tc of the central section of the faceplate 1A is set.

Thereafter, at step S3, the thickness ta of the peripheral section of faceplate 1A is set such that the thickness ta is substantially equal to or smaller than the thickness tc of the central section set at the preceding step S2.

Subsequently, at step S4, the radius of curvature Ri of the faceplate inner surface 1A(1), is set which satisfies the thickness tc of the central section and the thickness ta of the peripheral section which are set, at the preceding steps S2 and S3.

Then, at step S5, given strength calculations are performed with respect to the faceplate 1A of the panel portion 1 having the radius of curvature Ri of the faceplate inner surface 1A(1) and the radius of curvature Ro of the faceplate outer surface 1A(2), which are respectively set at the preceding steps S4 and S5.

Subsequently, at step S6, if it is determined that the result of the strength calculation which is performed at the preceding step S5 is equal to or more than a given value at the preceding step S5, the design of the faceplate 1A of the panel portion 1 having the radius of curvature Ri of the faceplate inner surface 1A(1) and the radius of curvature Ro of the faceplate outer surface 1A(2) is completed. On the other hand, if it is determined that the result of the strength calculation is equal to or less than the given value, the processing returns to the preceding step S3 and the processings at step S3 and succeeding steps are performed again.

The color cathode ray tube having the faceplate 1A of the panel portion 1, which is obtained in the above-mentioned manner, is constituted such that the thickness ta of the peripheral section of the faceplate 1A becomes substantially equal to or thinner than the thickness tc of the central section. Accordingly, it becomes possible to set the light transmittivity in the periphery of the screen to be substantially equal to or less than the light transmittivity at the center of the screen, and, hence, the brightness can be made substantially uniform over the whole screen.

Although the above constitution has been explained on the premise that the faceplate inner surface or the faceplate outer surface is spherical, it is needless to say that the above constitution is also applicable to a case in which the inner surface or the outer surface of the faceplate is aspherical.

Figure 3:
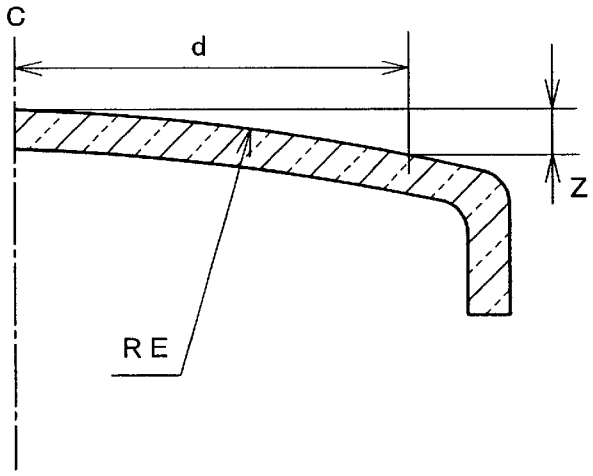
FIG. 3 is a sectional view showing an equivalent radius of curvature when a panel faceplate portion is aspherical.

FIG. 3 is a view which shows the equivalent radius of curvature when the faceplate portion of the panel is aspherical. As illustrated in FIG. 3, when the faceplate portion is aspherical, the equivalent radius of curvature RE is defined by a following equation based on the relationship between the equivalent radius of curvature RE and a fall amount Z from the center of the faceplate.

$$RE=(Z^2+d^2)/2Z$$

An advantage of the aspherical panel lies in that the difference in the thickness of the panel on the diagonal axis, on the major axis and on the minor axis can be independently determined with respect to a required predetermined value of brightness.

Figure 4:
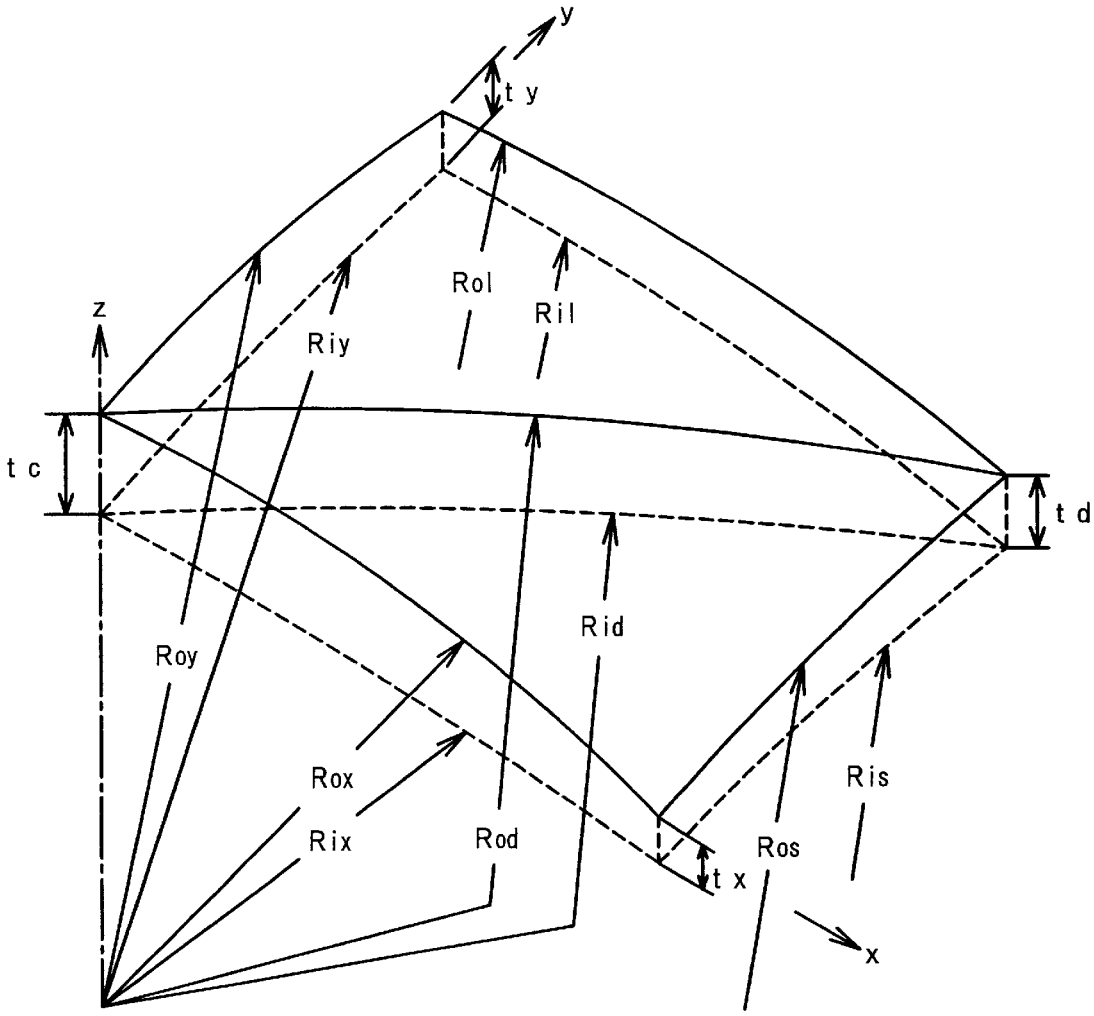
FIG. 4 is a diagram showing a partial perspective view of the constitution of a screen effective area of a faceplate portion of a panel in a color cathode ray tube of the present invention.

FIG. 4 is a perspective view which shows the constitution of the screen effective area of the faceplate 1A portion of the panel portion 1 in the color cathode ray tube of the embodiment of the present invention.

In FIG. 4, x indicates an axis in the horizontal direction on the screen (major axis), y indicates an axis in the vertical direction on the screen (minor axis), z indicates an axis in the direction which passes through the center of the screen and is perpendicular to both the major axis and the minor axis (tube axis direction), tc indicates the glass thickness of the central section in the tube axis direction, tx indicates the glass thickness of the peripheral section along the major axis in the tube axis direction, ty indicates the glass thickness of the peripheral section along the minor axis in the tube axis direction, td indicates the glass thickness of the peripheral section along the diagonal axis in the tube axis direction, Rix indicates the equivalent radius of curvature of the inner surface in the major axis direction, Riy indicates the equivalent radius of curvature of the inner surface in the minor axis direction, Rid indicates the equivalent radius of curvature of the inner surface in the diagonal axis direction, Rox indicates the equivalent radius of curvature of the outer surface in the major axis direction, Roy indicates the equivalent radius of curvature of the outer surface in the minor axis direction, and Rod indicates the equivalent radius of curvature of the outer surface in the diagonal axis direction.

With respect to the constitution of the screen effective area of the faceplate 1A portion of the panel portion 1 in the color cathode ray tube of this embodiment, the size relationship among the glass thickness tc of the central section, the glass thickness tx of the peripheral section along the major axis direction, the glass thickness ty of the peripheral section along the minor axis direction and the glass thickness td of the peripheral section along the diagonal axis direction is set to a relationship tc>td>tx, a relationship tc>td>ty or a relationship tc>ty>tx. Here, the constitution of the screen effective area of the faceplate 1A portion of the panel portion 1 may be constituted to have two or more of these relationships.

To set the size relationship of the glass thickness of respective sections in the above-mentioned manner, the size relationship among the equivalent radius of curvature Rix of the inner surface along the major axis direction, the equivalent radius of curvature Riy of the inner surface along the minor axis direction and the equivalent radius of curvature Rid of the inner surface along the diagonal axis direction is set to a relationship Rix>Rid, a relationship Rix>Riy or a relationship Rid>Riy. Further, the size relationship among the equivalent radius of curvature Rox of the outer surface along the major axis direction, the equivalent radius of curvature Roy of the outer surface along the minor axis direction and the equivalent radius of curvature Rod of the outer surface along the diagonal axis direction is set to a relationship Rox>Roy or a relationship Rod>Roy. Here, the size relationship of the glass thickness of respective sections may be constituted to have two or more of these relationships.

With respect to the color cathode ray tube having the faceplate 1A portion of the panel portion 1 which is obtained in the above-mentioned manner, since the equivalent radius of curvature Rid of the inner surface along the diagonal direction is smaller than the equivalent radius of curvature Rix of the inner surface along the major axis direction, corresponding to the curved shape of the inner surface of the faceplate, the radius of the curvature of the shadow mask, which is arranged to face the phosphor screen formed on the inner surface of the faceplate in an opposed manner and performs color selection, is also set to be small between the center and the peripheral section along the diagonal direction. The cathode ray tube having such a constitution can exhibit an increased molding retaining strength of the curved surface of the shadow mask between the peripheral section along the diagonal direction which is most distant from the center of the shadow mask and the center so that the curved surface is hardly deformed, whereby the electron beams which pass through apertures of the shadow mask can normally impinge on the phosphor screen (can perform normal color selection) thus preventing the color purity of the displayed image from being deteriorated.

Here, the glass thickness td of the peripheral section along the diagonal direction is set to a value in a range which is smaller than the glass thickness tc of the central section and is larger than the glass thickness tx of the peripheral section in the major axis direction or the glass thickness ty of the peripheral section in the minor axis direction; and, hence, the brightness of the display image can be enhanced and the uniformity of the brightness over the entire surface can be maintained.

Further, since the equivalent radius of curvature Riy of the inner surface along the minor axis direction is set to be smaller than the equivalent radius of curvature Rix of the inner surface along the major axis direction or the equivalent radius of curvature Rid of the inner surface along the diagonal axis direction, corresponding to the curved shape of the inner surface of the faceplate, the radius of the curvature of the shadow mask, which is arranged to face the phosphor screen formed on the inner surface of the faceplate in an opposed manner and performs color selection, is also set to be small at the peripheral section along the minor axis direction. The cathode ray tube having such a constitution can exhibit an increased mechanical strength of the curved surface at the peripheral section along the minor axis direction, which is liable to be easily influenced by vibrations or an impact, such as from dropping or the like, of the shadow mask, so that the curved surface is hardly deformed, whereby the electron beams which pass through the apertures of the shadow mask can normally impinge on the phosphor screen (can perform the normal color selection), thus preventing the color purity of the displayed image from being deteriorated.

Here, since the glass thickness ty of the peripheral section along the minor axis direction is set to be thicker than the glass thickness tx of the peripheral section along the major axis direction, or since the equivalent radius of curvature Riy of the inner surface in the minor axis direction is set to be smaller than the equivalent radius of curvature Rix of the inner surface in the major axis direction or the equivalent radius of curvature Rid of the inner surface in the diagonal direction, the concentration of the stress strain caused by the vacuum in the glass bulb (panel portion) at the peripheral section along the minor axis direction can be alleviated so that the deterioration of the mechanical strength of the glass bulb (panel portion) can be prevented.

Further, in addition to setting the relationship in which the equivalent radius of curvature Riy of the inner surface in the minor axis direction is made smaller than the equivalent radius of curvature Rix of the inner surface in the major axis direction or the equivalent radius of curvature Rid of the inner surface in the diagonal axis direction, the equivalent radius of curvature Roy of the outer surface in the minor axis direction is set to be smaller than the equivalent radius of curvature Rox of the outer surface in the major axis direction or the equivalent radius of curvature Rod of the outer surface in the diagonal axis direction. Accordingly, the concentration of the stress strain caused by the vacuum in the glass bulb (panel portion) at the peripheral section along the minor axis direction can be alleviated, so that the deterioration of the mechanical strength of the glass bulb (panel portion) can be prevented.

As a method which compensates for the difference in brightness between the center and the periphery, a method which sets the hole transmittivity of the black matrix (BM) at the periphery larger than that at the center is considered.

Figure 5:
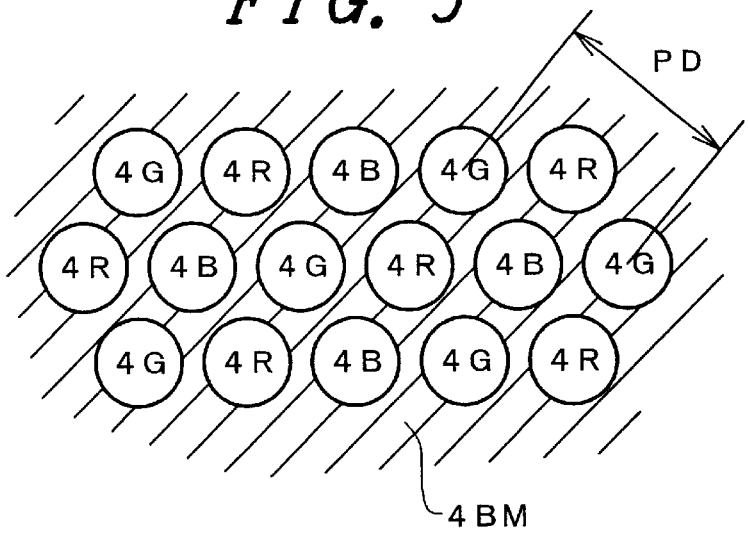
FIG. 5 is a diagram of a black matrix having a dot type phosphor screen.
Figure 6:
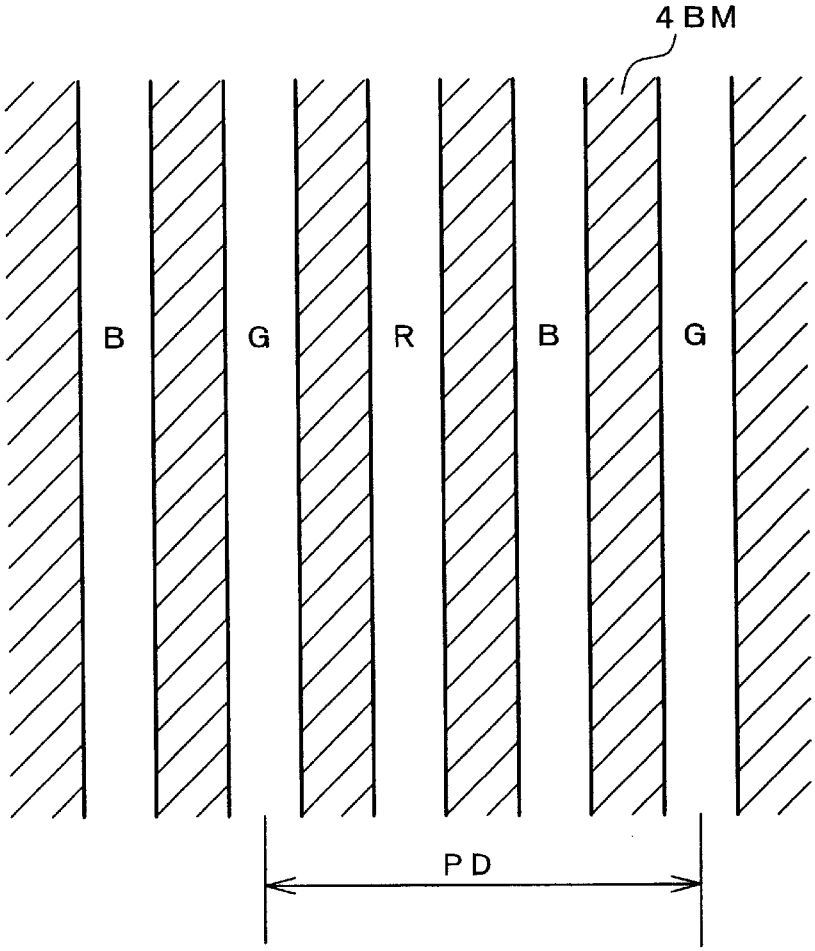
FIG. 6 is a diagram of a black matrix having a stripe type phosphor screen.

FIG. 5 is a diagram of a black matrix having a dot type phosphor screen, while FIG. 6 is a diagram of a black matrix having a stripe type phosphor screen.

Here, the BM hole transmittivity is a rate of portions which lack in graphite 4BM as shown in FIG. 5 and FIG. 6, that is, a rate which allows light to pass through the portions. Here, PD denotes the dot pitch, which is an interval between phosphor bodies of the same color. However, when a panel which has a glass thickness that is thicker at the periphery than at the center is used in the same manner as a conventional panel, unless the BM hole transmittivity at the periphery is increased by equal to or more than 10%, it is difficult to obtain an approximately uniform brightness over the center and the periphery. As means to increase the BM hole transmittivity at the periphery of the screen without sacrificing the landing tolerance, there exists a method which increases the dot pitch at the periphery of the screen relative to that at the center of the screen. However, when the dot pitch is made excessively large at the periphery, it gives rise to a deterioration of the resolution at the periphery of the screen. Further, when the hole transmittivity is increased at the periphery, since the electron beams which have passed through the apertures of the shadow mask cannot be made sufficiently larger than the holes of the BM, it gives rise to a loss of beams, which is a phenomenon in which the electron beams fail to cover the hole portions. To prevent such loss of beams, the transmittivity of the shadow mask may be increased. However, this gives rise to a problem that the strength of the shadow mask is lowered.

Figure 7:
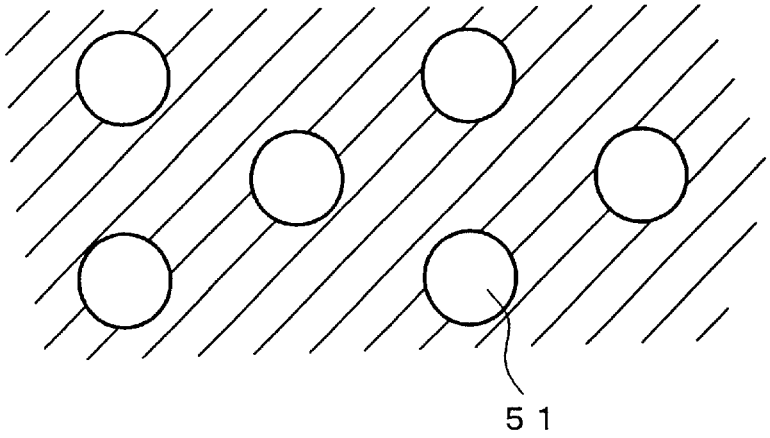
FIG. 7 is a diagram of a dot type shadow mask.

FIG. 7 is a diagram of a dot type shadow mask. Here, the transmittivity of the shadow mask is a rate of the area of the shadow mask apertures 51 as shown in FIG. 7.

The present invention is characterized by the fact that the thickness of the panel is set such that the thickness of the periphery of the panel is equal to the thickness of the center, or is thinner than the center and the BM hole transmittivity is defined so as to be based on a relationship with respect to the thickness of the panel, so that the difference in brightness between the center and the periphery can be made small, while ensuring the landing tolerance.

Here, even when the thickness of the panel and the BM hole transmittivity are made substantially equal between the center and the periphery, due to reasons such as (1) the weight of the phosphor dots becomes smaller at the periphery of the screen than the center of the screen, (2) the reflectance of a metal back which reflects Light from the phosphor is decreased at the periphery of the screen and the like, the brightness of the periphery becomes lower than that of the center. Accordingly, there arises a case in which, even when the thickness of the panel is slightly thin at the periphery, it is necessary to increase the BM hole transmittivity at the periphery. Even in such a case, the BM hole transmittivity of the periphery of the screen relative to the center of the screen can be set to be equal to or less than 110%, and furthermore, the BM hole transmittivity can be set to be equal to or less than 105% depending on the balance between the thickness and the difference in brightness. According to the most preferred embodiment of the present invention, the BM hole transmittivity of the periphery is set to be lower than that of the center. Further, when the BM hole transmittivity at the periphery of the screen is set to be equal to or more than 70% of the BM hole transmittivity at the center of the screen, the brightness ratio between the periphery of the screen and the center of the screen can be enhanced. By setting the BM hole transmittivity at the periphery of the screen to be equal to or more than 90% of the BM hole transmittivity at the center of the screen, the brightness ratio with respect to the center of screen can be further enhanced. Due to such a constitution, the brightness difference between the center and the periphery can be eliminated, and it becomes possible to attain the necessary landing tolerance at the periphery. Here, when the BM hole transmittivity at the periphery of the screen is set to be equal to or less than 110% of the BM hole transmittivity at the center of the screen, the dot pitch at the periphery also can be set to be equal to or less than 110% of the dot pitch at the center, and, hence, the deterioration of the resolution at the periphery is not so noticeable. In the same manner, provided that the BM hole transmittivity at the periphery of the screen is set to be equal to or less than 105% of the BM hole transmittivity at the center of the screen, the dot pitch at the periphery also can be set to be equal to or less than 105% of the dot pitch at the center, and, hence, the deterioration of the resolution at the periphery is hardly noticeable. Further, since it is no longer necessary to excessively increase the transmittivity of the shadow mask at the periphery or it becomes possible to decrease the transmittivity of the shadow mask at the periphery, the strength of the shadow mask can be ensured.

Provided that the BM hole transmittivity at the periphery of the screen is set to be equal to or less than 110% of the BM hole transmittivity at the center of the screen, it is also possible to restrict the transmittivity at the periphery of the shadow mask to be equal to or less than 110% of the transmittivity at the center of the shadow mask. To take the tolerance of the strength of the shadow mask into consideration, it is preferable to set the transmittivity of the shadow mask at the periphery of the screen lower than that of the transmittivity of the shadow mask at the center of the screen.

Figure 8:
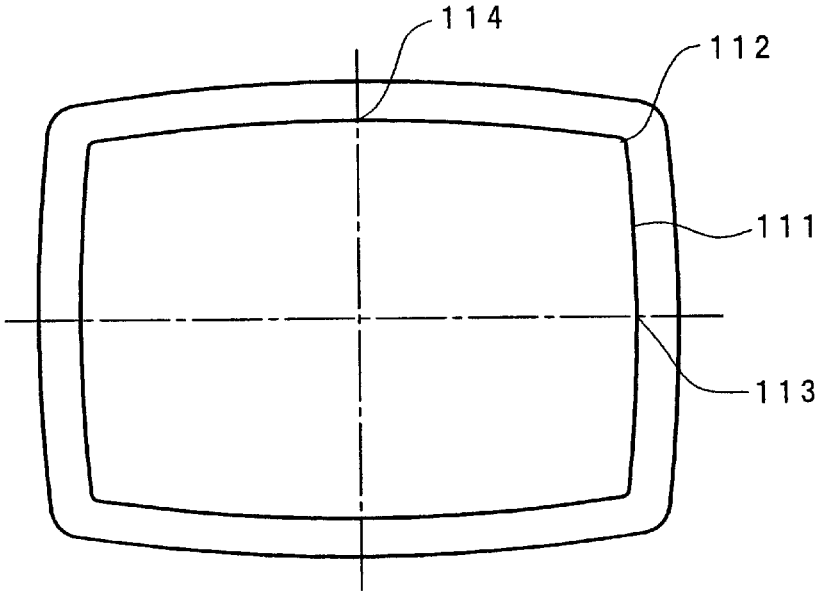
FIG. 8 is a plan view of a panel illustrating the present invention.

FIG. 8 is a plan view of the panel provided for the present invention. Here, as shown in FIG. 8, the faceplate peripheral section is a peripheral area which corresponds to phosphor dots or stripes of the phosphor film 4, which is formed on the faceplate inner surface 1A(1) by coating, that is, a peripheral section of an effective screen 111 on which an image is displayed.

As shown in FIG. 8, the effective screen periphery can be represented by a periphery 112 along the diagonal direction, a periphery 113 along the major axis direction, and a periphery 114 along the minor axis direction. In general, the periphery which generates the most crucial problem with respect to a difference in brightness between the periphery and the center of the screen is the periphery 112 along the diagonal direction. Then, the periphery along the major axis direction 113 and the periphery 114 along the minor axis direction follow sequentially. In reality, the thickness of the panel, the BM hole transmittivity and the shadow mask transmittivity of the above-mentioned respective portions may be set in response to a request for a brightness distribution of a product.

In a color cathode ray tube for a display monitor to be used at a computer terminal or the like, in many cases, so-called tint (having transmittivity of 56.8% at a late thickness of 10.6 mm and having EIAJ standard transmittivity when measured with light having wavelength of 546 nm) is used as a panel glass for increasing the contrast, and a dark tint (transmittivity of 46% at a plate thickness of 10.6 mm and having EIAJ standard transmittivity when measured with light of wavelength 546 ma) is used to further enhance the contrast. The present invention is particularly effective in a case where glass having such low transmittivity is used.

Further, in a high definition tube which sets the dot pitch at the center to be equal to or less than 0.26 imu, the landing tolerance of the electron beams to the phosphor is small at the periphery of the screen, so that it is difficult to increase the BM hole transmittivity at the periphery. Accordingly, the present invention is particularly applicable to such a color cathode ray tube for a display monitor.

Further, the difference in brightness between the center and the periphery of the screen is liable to be noticeable in a large-sized tube. The present invention is particularly effective in a large-sized color cathode ray tube for a display monitor having an effective screen size in the diagonal direction which is set to be equal to or more than 46 cm (19 inches).

An example in which the present invention is applied to a color cathode ray tube for a display monitor having a size of 19 inches will be described. Here, the panel base is a tint.

| | center | diagonal periphery |
|---|---|---|
| panel thickness | 12.5 mm | 11.3 mm |
| BM hole transmittivity | 42.4% | 39.8% |
| shadow mask transmittivity | 17.6% | 17.1% |
| dot pitch | 0.26 mm | 0.27 mm |

To enhance the mechanical strength, a shadow mask which is applied to the 19 inch color cathode ray tube for a display monitor is shaped to have a given curved surface, and the weight of an apertured portion after coating a blackened film on a surface thereof is set to be equal to or less than 48 g. Due to such a constitution, it becomes possible to prevent the deformation of the curved surface of the peripheral section of the shadow mask, which may be caused by dropping the color cathode ray tube or an impact to cause vibrations or the like.

Figure 9A:
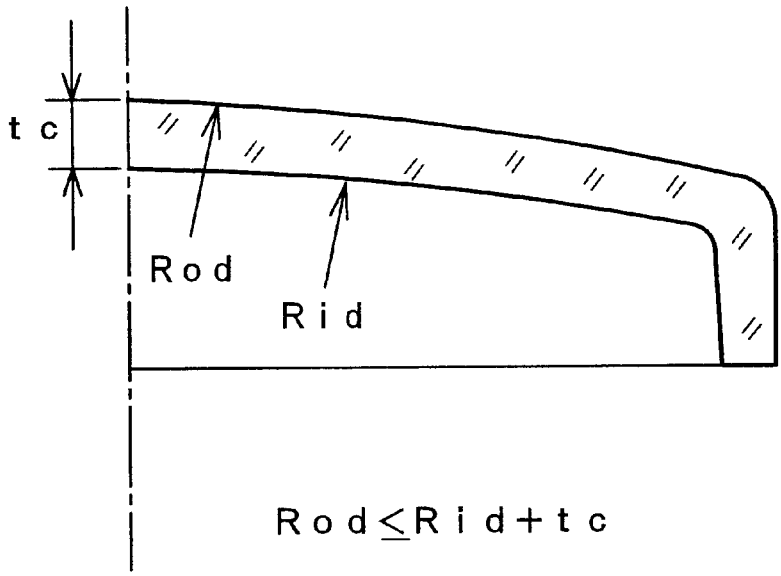
FIGS. 9A and 9B are cross-sectional views of a panel according to another embodiment of the present invention.
Figure 9B:
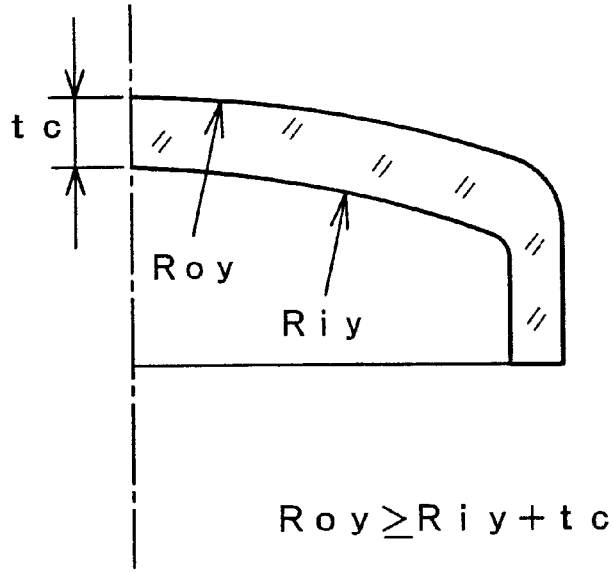

Subsequently, FIGS. 9A and 9B are partial cross-sectional views of a panel according to another embodiment of the present invention, wherein FIG. 9A is a cross-sectional view in the diagonal direction of the screen and FIG. 9B is a cross-sectional view in the minor axis direction of the screen.

With respect to the brightness ratio between the periphery and the center of the screen, the periphery 114 along the minor axis hardly produces a problem. On the other hand, with respect to the strength of the shadow mask, the periphery along the minor axis shows the least tolerance. The strength of the shadow mask can be increased by providing a curvature. The curved surface of the shadow mask is strongly influenced by the curvature of the inner surface of the panel. From this point of view, it is preferable to select a small radius of curvature for the inner surface of the panel. That is, the panel thickness at the diagonal periphery of the screen is set to be smaller than the panel thickness at the center, and the panel thickness at the periphery of the screen along the minor axis is set to be larger than the panel thickness at the center, so that the brightness difference between the center and the periphery can be decreased while maintaining the required shadow mask strength. This embodiment is shown in FIGS. 9A and 9B.

Even when the panel thickness at the center and the panel thickness at the periphery are substantially equal, the brightness difference between the center and the periphery of the screen can be decreased compared to a conventional example. In this case, it is preferable to set the BM hole transmittivity at the periphery of the screen to be equal to or more than 70% of the BM hole transmittivity at the center of the screen, and it is more preferable to set the BM hole transmittivity at the periphery of the screen to be equal to or more than 90% of the BM hole transmittivity at the center of the screen. It is further preferable to set the BM hole transmittivity at the periphery to be larger than the BM hole transmittivity at the center. Even in such a case, it becomes possible to improve the brightness ratio compared to a conventional case in which the panel thickness becomes large at the diagonal periphery, and even when the hole transmittivity at the diagonal periphery is equal to or less than 110% of the hole transmittivity at the center, the brightness difference can be restricted to a practical brightness difference.

Provided that the hole transmittivity at the periphery of the screen is set to be equal to or less than 110% of the hole transmittivity at the center of the screen, the dot pitch at the periphery of the screen can be suppressed so as to be equal to or less than 110% of the dot pitch at the center of the screen, so that the deterioration of the resolution at the periphery of the screen is not so noticeable. In the same manner, provided that the hole transmittivity at the periphery of the screen is set to be equal to or less than 105%, it becomes possible to suppress the dot pitch at the periphery of the screen to equal to or less than 105% of the dot pitch at the center of the screen, so that the deterioration of the resolution at the periphery of the screen becomes hardly noticeable.

Figure 10A:
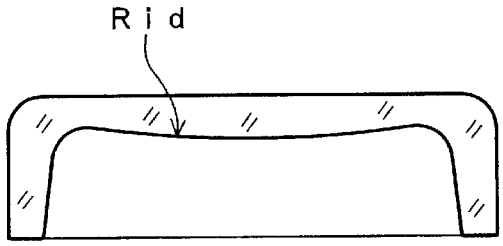
FIGS. 10A and 10B are cross-sectional view of a panel according to still another embodiment of the present invention.
Figure 10B:
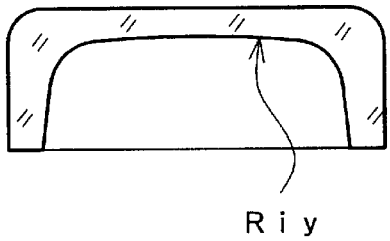
Figure 11:
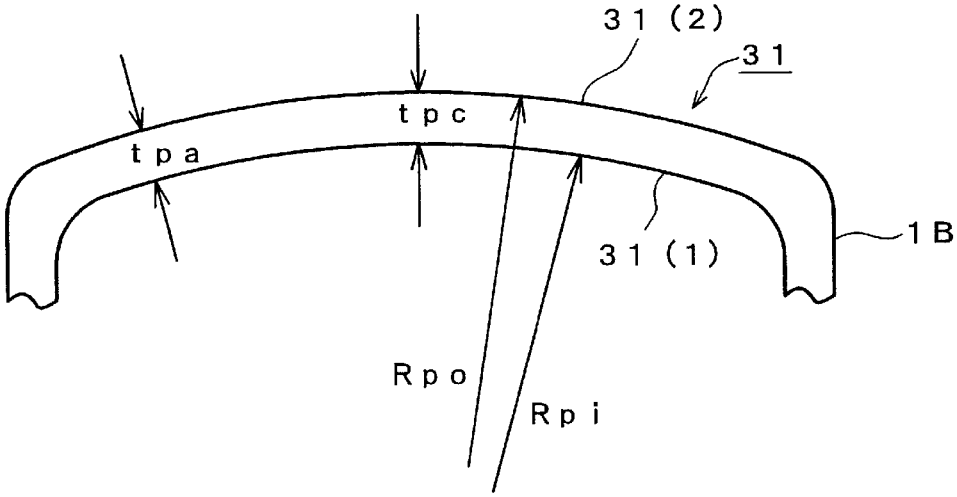
FIG. 11 PRIOR ART
FIG. 11 is a diagrammatic cross-sectional view of a panel formed according to a conventional technique.

FIGS. 10A and 10B are cross-sectional views of a panel according to still another embodiment of the present invention, wherein FIG. 10A is a cross-sectional view along the diagonal direction of the screen and FIG. 10B is a cross-sectional view along the minor axis direction of the screen.

When the outer surface of the panel is flat, according to the present invention, the inner surface of the panel has a radius of curvature in the inverse direction with respect to the diagonal direction as shown in FIG. 10A. Even in such a case, by setting the radius of curvature Rid in the inverse direction in the diagonal direction and by setting the radius of curvature Riy in the normal direction with respect to the minor axis direction, the brightness ratio between the center and the diagonal periphery can be decreased while maintaining the strength of the shadow mask.

When the inner surface of the panel is flat, by giving a proper curvature to the outer surface of the panel, the brightness ratio between the center of the screen and the diagonal periphery of the screen can be decreased.

According to the present invention, the brightness difference between the center of the screen and the periphery of the screen can be reduced while maintaining the landing tolerance at the periphery of the screen.

Further, according to the present invention, the brightness difference between the center of the screen and the periphery of the screen can be reduced without lowering the mechanical strength of the shadow mask and the glass bulb.

As has been described heretofore, the color cathode ray tube according to the present invention is suitable for use in a color television set having a large screen or a high definition color display monitor.

What is claimed is:

1. A color cathode ray tube comprising a glass bulb which includes a panel portion having a faceplate portion having a phosphor screen on an inner surface thereof, a neck portion which mounts an electron gun inside thereof, and a funnel portion which connects the panel portion and the neck portion, wherein a thickness of a screen effective area of the faceplate portion along a tube axis direction is tc at a central section thereof, is tx at a peripheral section thereof along a major axis direction and is td at a peripheral section thereof along a diagonal direction, and wherein a relationship tc>td>tx is established.

2. A color cathode ray tube comprising a glass bulb which includes a panel portion having a faceplate portion having a phosphor screen on an inner surface thereof, a neck portion which mounts an electron gun inside thereof, and a funnel portion which connects the panel portion and the neck portion, wherein a thickness of a screen effective area of the faceplate portion along a tube axis direction is tc at a central section thereof and is tx at a peripheral section thereof along a major axis direction, and a relationship tc>tx is established, and wherein an equivalent radius of curvature of the screen effective area of the inner surface of the faceplate portion is Rix in the major axis direction and is Rid in a diagonal direction, and a relationship Rix>Rid is established.

3. A color cathode ray tube comprising a glass bulb which includes a panel portion having a faceplate portion having a phosphor screen on an inner surface thereof, a neck portion which mounts an electron gun in the inside thereof, and a funnel portion which connects the panel portion and the neck portion, the color cathode ray tube having a shadow mask mounted with respect to the phosphor screen on the inner surface of the faceplate portion, wherein a thickness of a screen effective area of the faceplate portion along a tube axis direction is tc at a central section thereof, is tx at a peripheral section thereof along a major axis direction and is ty at a peripheral section thereof along a minor axis direction, and wherein a relationship tc>ty>tx is established.

4. A color cathode ray tube comprising a glass bulb which includes a panel portion having a faceplate portion having a phosphor screen on an inner surface thereof, a neck portion which mounts an electron gun inside thereof, and a funnel portion which connects the panel portion and the neck portion, wherein a thickness of a screen effective area of the faceplate portion along a tube axis direction is tc at a central section thereof and is ty at a peripheral section thereof along a minor axis direction and is td at the peripheral section along a diagonal direction, and a relationship tc>td>ty is established, wherein an equivalent radius of curvature of a screen effective area of the inner surface of the faceplate portion is Riy in the minor axis direction and is Rid in the diagonal direction, and a relationship Rid>Riy is established, and wherein an equivalent radius of curvature of a screen effective area of an outer surface of the faceplate portion is Roy in the minor axis direction and is Rod in the diagonal direction, and a relationship Rod>Roy is established.

* * * * *